United States Patent [19]

Klausbruckner et al.

[11] 4,362,459

[45] Dec. 7, 1982

[54] SYSTEM FOR STORING AND TRANSPORTING GUIDED MISSILES AND SIMILAR FLYING BODIES

[75] Inventors: Gert Klausbruckner, Moosburg; Bernd Tüshaus, Högertshausen, both of Fed. Rep. of Germany

[73] Assignee: Steinbock GmbH, Moosburg, Fed. Rep. of Germany

[21] Appl. No.: 163,567

[22] Filed: Jun. 27, 1980

[30] Foreign Application Priority Data

Jul. 27, 1979 [DE] Fed. Rep. of Germany ..... 2930555

[51] Int. Cl.[3] ..... B65G 67/002

[52] U.S. Cl. ..... 414/584; 89/1.815; 89/1.819; 280/79.1 A; 280/79.3; 280/99; 410/33; 280/408; 410/46; 414/234; 414/261; 280/509; 294/83 R; 414/227

[58] Field of Search ..... 414/227, 261, 316, 584, 414/680, 233, 234; 89/1.5 G, 1.5 H, 1.5 R, 1.8, 1.801, 1.804, 1.805, 1.806, 1.815, 1.819; 294/83 R, 84; 52/369, 371; 256/59, DIG. 6; 248/251, 345.1, 74 R; 280/204, 199, 99, 504, 507-509, 79.1 A, 79.3, 47.35

[56] References Cited

U.S. PATENT DOCUMENTS

| | | | |
|---|---|---|---|
| 1,337,391 | 4/1920 | Cooper | 280/509 |
| 2,763,493 | 9/1956 | Hutchinson | 280/408 X |
| 2,949,823 | 8/1960 | Ross et al. | 89/1.815 |
| 2,970,705 | 2/1961 | De Witt, Jr. | 214/14 |
| 3,406,606 | 10/1968 | Schöffl | 89/1.819 |
| 3,529,848 | 9/1970 | Harvey | 280/99 |
| 3,659,892 | 5/1972 | Briggs | 410/46 |
| 3,806,160 | 4/1974 | Duerksen | 280/408 X |
| 3,820,811 | 6/1974 | Lapham | 280/408 X |
| 4,093,303 | 6/1978 | Nelson | 410/51 |

FOREIGN PATENT DOCUMENTS

| | | |
|---|---|---|
| 883258 | 7/1953 | Fed. Rep. of Germany . |
| 1124396 | 2/1962 | Fed. Rep. of Germany . |
| 1176344 | 8/1964 | Fed. Rep. of Germany . |
| 2024889 | 12/1971 | Fed. Rep. of Germany . |
| 1312439 | 11/1962 | France . |
| 1472144 | 1/1967 | France . |
| 563431 | 8/1944 | United Kingdom . |
| 1000272 | 8/1965 | United Kingdom . |
| 1357976 | 12/1972 | United Kingdom . |
| 1485055 | 1/1974 | United Kingdom . |
| 1382806 | 2/1975 | United Kingdom . |
| 1406675 | 9/1975 | United Kingdom . |
| 1422361 | 1/1976 | United Kingdom . |

OTHER PUBLICATIONS

Stapeln von Paletten im Lager (Z. Fördern und Heben 1958, Heft 1, Seiten 28+29).

*Primary Examiner*—David M. Mitchell
*Assistant Examiner*—M. J. Hill
*Attorney, Agent, or Firm*—Toren, McGeady & Stanger

[57] ABSTRACT

System for storing and transporting guided missiles and similar flying bodies includes a storage building and movable storage structures for supporting multiple guided missiles. The storage building is sized so that a row of the storage structures can be arranged along one side wall of the storage building with the normal travel direction of the structures being arranged transversely of the direction of the row and of the adjacent side wall. In the row, the storage structures are closely spaced so that there is no walkway between them. A passageway is provided within the storage building along the row of storage structures so that each storage structure can be moved out of the row without moving adjacent storage structures and then turned on a minimum turning circle in the passageway for movement out of the storage building.

29 Claims, 7 Drawing Figures

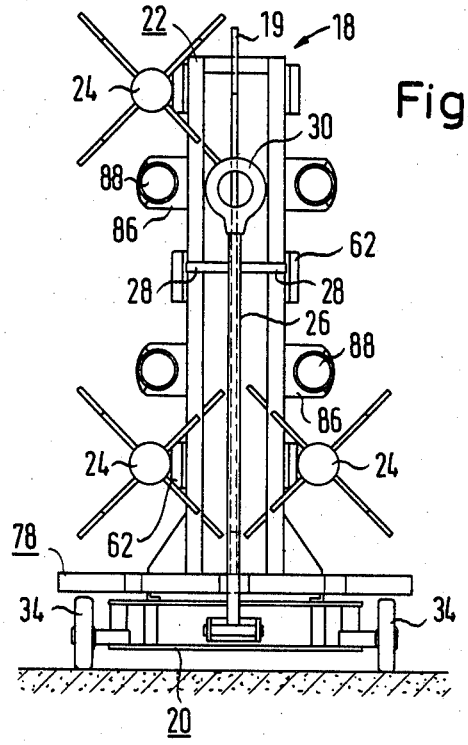
Fig. 3
Fig. 7
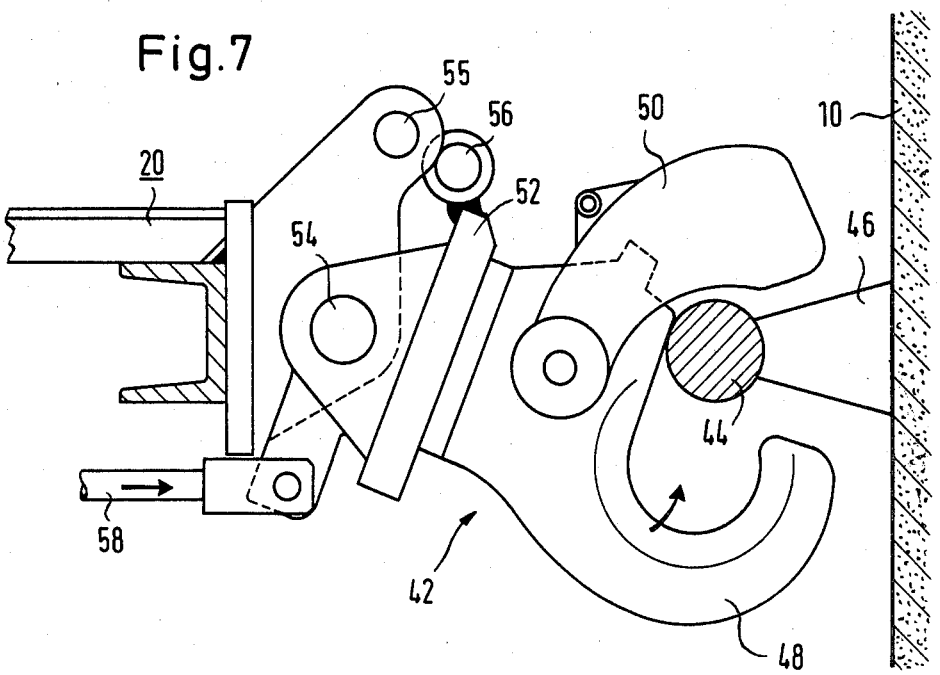

SYSTEM FOR STORING AND TRANSPORTING GUIDED MISSILES AND SIMILAR FLYING BODIES

SUMMARY OF THE INVENTION

The present invention is directed to a system for storing and transporting guided missiles and similar flying bodies and includes storage structures positionable in a storage building for storing the guided missiles.

At the present time guided missiles are stored in stationary shelf structures including half-shell shaped arms in which the guided missiles are placed. A special building, (Side-Winder building) is used for storage and has a storage area of 14.3×9.25 meters. For operational reasons a specific space is needed between the shelf structures, accordingly, there is no maximum utilization of the storage space.

It is the primary object of the present invention to provide an improved system for storing and transporting guided missiles which provides a space-saving storage arrangement, especially in a storage building.

In accordance with the present invention storage structures are used which can be moved and steered. Further, they can be arranged in a storage area in a row so that the row extends in a direction transversely of the normal travel direction of the storage structures. Within the row, the storage structures are arranged closely together without any walkways between adjacent storage structures. A passageway is provided along one side of the row so that the long direction of the passageway extends transversely of the normal travel direction of the storage structures within the row. Further, the width of of the passageway is just sufficient so that a storage structure can be moved out of the row into the passage without moving the adjacent storage structures.

The present invention is not only advantageous because it saves space in the storage building for the guided missiles, but because the storage structures can also serve for transporting the guided missiles, that is, the guided missiles can be moved on the storage structures from the storage building to a mission carrier, such as an aircraft, without requiring any intermediate transfer.

As a space-saving feature, the storage structures have a number of wheels and each of the wheels can be steered so that it is possible to provide a narrow passageway for moving the storage structures into and out of the stored positions within the storage building.

It is particularly advantageous if the storage building is sized so that two rows of storage structures are spaced apart by a common passageway whereby the common passageway serves in moving the support structures into and out of each of the two rows. To provide for the movement of the storage structures manually as well as by tractor, a rod mounted on the storage structure acts as a tow bar. The rod includes a handle and coupling means for securing the storage structure to a tractor or another storage structure.

The rod which acts as the tow bar is also used for steering the wheels on the support structure so that the structure can be turned on a minimum turning circle in being moved from the row in the storage building into the passageway.

Because of the nature of the load carried by the storage structure, it is particularly desirable to provide a brake. The brake is actuated by the rod used as the tow bar. By pivoting the rod about a horizontal axis the brake can be applied. The brake actuation afforded by this arrangement is particularly simple.

In a particularly economical arrangement, a brake shoe is associated with one of the wheels and can be used for braking only when the wheels of the storage structure are oriented in the normal travel direction and not when they are turned for movement along a turning circle. Movement of the rod to actuate the braking action cannot be effected unless the wheels are oriented in the normal travel direction. Since the support structure is moved at limited speeds, this braking arrangement has proved to be totally adequate.

Up to the present time it has been the usual procedure to secure guided missiles against any unintentional movement caused by an accidental ignition. To afford this action, each guided missile has been provided with a thrust destroyer in the form of a thrust reverser. These thrust destroyers were placed individually on the nozzle openings of the missiles.

In the present invention, the problem of accidental startup of the guided missiles is avoided in a simple manner by providing the storage structure with a safety catch which prevents movement of the storage structure when it is in the stored position because of any accidental thrust generated by one of the missiles. Each missile on the storage structure is secured against accidental movement by means of interacting stops.

Advantageously, the safety catch is positioned at the opposite end of the support structure from the rod or tow bar. At this location, the catch is at the thrust end of the guided missiles supported on the support structure. In such an arrangement, only tension stresses act on the storage structure and it is not under compressive stress in the event of an accidental thrust being generated by a guided missile. Accordingly, a lighter storage structure can be used.

To afford the ability to absorb high thrusts by way of the storage structure, the safety catch is engageable with a support fixed to the storage building.

In an especially advantageous arrangement, the safety catch is in the form of a coupling secured to the opposite end of the storage structure from the rod or tow bar. In addition to affording a coupling with the storage building, it can also be used for connecting individual storage structures together to form a train of such structures. With such an arrangement, it is not necessary to provide a special safety catch on the storage structure. In a preferred embodiment of the safety catch, the coupling is in the form of a hook coupling and the support on the storage building is a bar which extends parallel to the row of support structures. Each of the storage structures in the row can be coupled to the support bar. Such an arrangement is not only economical, it is also especially easy to operate, since any lateral displacement of the storage structure when it is being maneuvered into position in the row has no adverse effect on the connection of the coupling to the support.

Use of conventional hook couplings is possible by securing the coupling to a carrier plate which, in turn, is attached to the storage structure. The carrier plate can be pivoted about a horizontal axis to assure proper engagement and disengagement with the support on the storage building.

To facilitate the operation of the safety catch, a remote control device is provided on the support structure at the end opposite the coupling. Such an arrangement is particularly valuable when the individual support structures must be moved out of place in a row in a very rapid manner without using up time in releasing the safety catch. To assure the safe operation of the catch, in its latched position it can be secured in place by a safety bolt.

In a preferred arrangement of the hook coupling, the coupling is open at the top so that in a downwardly pivoted position it can be moved under the support attached to the storage building and then pivoted upwardly into engagement with the support. Once the hook coupling engages the support, a closure part can be placed over the opening for locking the coupling to the support.

In the known storage of guided missiles in half-shell shaped arms, a complicated construction of the storage structure was involved and the guided missiles could be turned on the storage structures. This arrangement caused the side fins of the guided missiles to collide during turning with the possibility that the fins could be damaged. In such known storage structures this problem could be overcome only by spacing the guided missiles apart to such an extent that contact between the side fins cannot occur. If such an arrangement is used, there is an unfavorable waste of storage space.

In accordance with the present invention, accidental contact between adjoining guided missiles on the storage structure is avoided especially when the storage structures are being moved into and out of the rows in the storage building. To assure that the missiles do not move on the storage structures a fastening arrangement is provided for positioning the missiles on the storage structure and such an arrangement can also be used for securing the missiles on a mission carrier. Such an arrangement provides a rigid attachment and does not permit any movement of the guided missile relative to the storage structure, accordingly, accidental movement of the guided missiles, which could lead to a collision, is not possible. When the missiles are being loaded or unloaded, the attachment arrangement shows the persons carrying out the loading or unloading, the proper orientation of the missiles so that once properly positioned the missiles cannot contact one another.

The attachment arrangement utilizes interengaging parts which make it especially easy to secure the guided missiles on the storage structure and also on a mission carrier. One feature of the attachment arrangement which is particularly significant is a stop which prevents movement of the guided missile in the event of an accidental ignition. The attachment arrangement provides guide-in surfaces for leading the guided missiles into the proper position on the storage structure. Such an arrangement aids the personnel loading the missiles on the storage structure. Further, the attachment arrangement provides shaped guides which hold the missiles on the storage structure and prevent any displacement of the missiles in the event the storage structure is accelerated during transportation.

Since the storage structures are movable, it is necessary to prevent any collisions between guided missiles on adjacent storage structures which are movable relative to one another. To prevent such collisions, the storage structure is shaped to prevent contact between missiles on adjoining storage structures. The separation of guided missiles is provided by the shape of a platform on the support structure. Further, the platform can be recessed along its length permitting personnel access to the guided missiles during loading and unloading without reducing the protection against collision.

In addition to the mounts for the guided missiles, the storage structure includes mounts for accessory parts needed to complete the guided missiles when they are loaded onto a mission carrier. The storage structure includes a safety partition for separating the warheads of certain of the missiles mounted on the support structure.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 3 is a front view of the storage structure shown in FIG. 2;

FIG. 7 is a side view of a safety catch for securing a storage structure in the storage building, in accordance with the present invention.

DETAIL DESCRIPTION OF THE INVENTION

Figure 1:
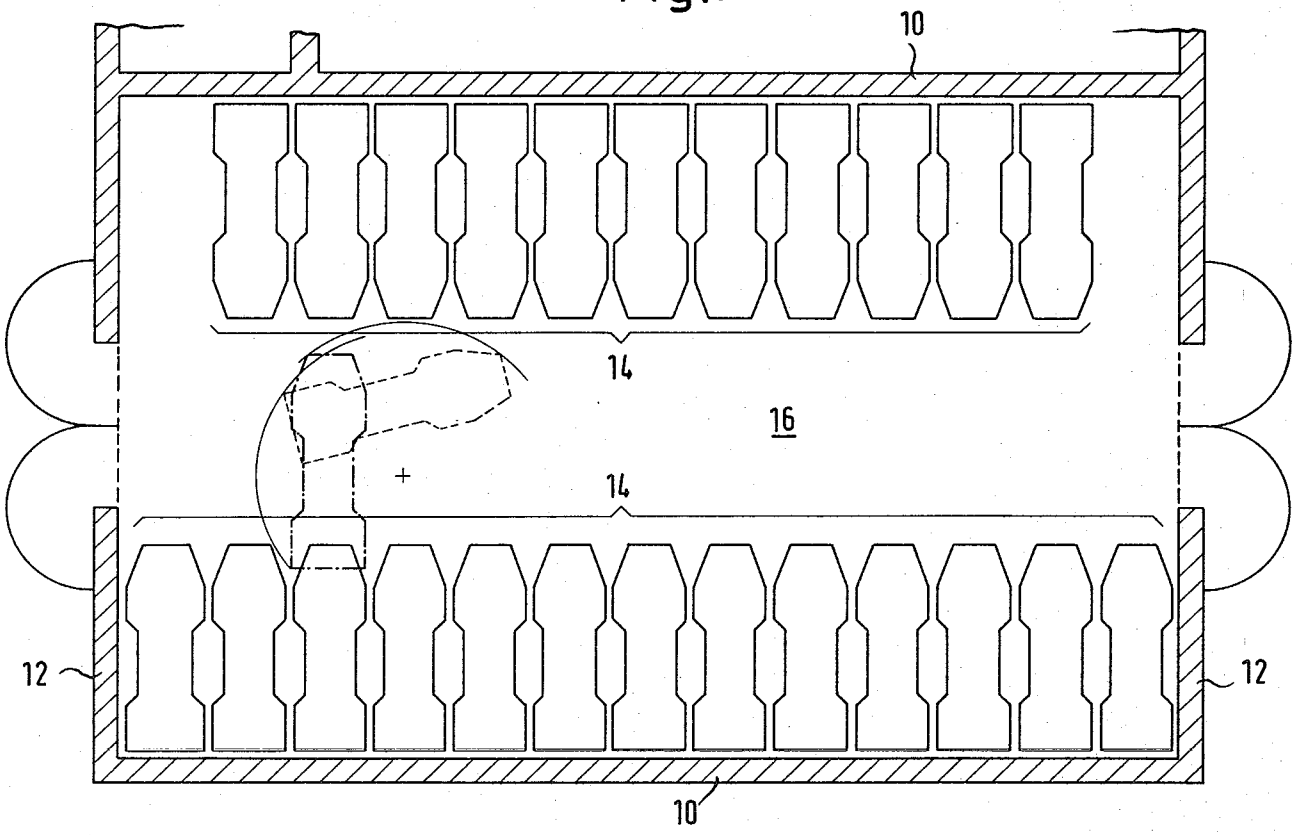
FIG. 1 is a plan view showing a storage building in section with the storage structures arranged in rows within the building.

In FIG. 1 a storage building is shown in section having a pair of elongated side walls 10 and a pair of end walls 12 extending across the opposite ends of the side walls. End walls 12 have doors in them for entering and leaving the building. Within the storage space defined by the side walls 10 and end walls 12 of the storage building, a row 14 of storage structures 18 extends along each of side walls 10. The storage structures 18 are positioned close to one another with the front end-rear end direction or normal travel direction of the support structures extending transversely of the long direction of the rows 14 or of the side walls 10. The rows 14 on opposite sides of the storage building are spaced apart forming a passageway 16 which extends between the end walls 12 and is aligned with the doors in the end walls. The storage structures 18 are movable over the floor of the storage building and, as shown in dot-dash lines in FIG. 1, a storage structure 18 can be moved out of its position in either of the rows 14 moving first in its normal travel direction into the passageway 16 and then moving along a turning circle so that the normal travel direction of the storage structure extends parallel to the long direction of the side walls 10 and of the rows 14.

Figure 2:
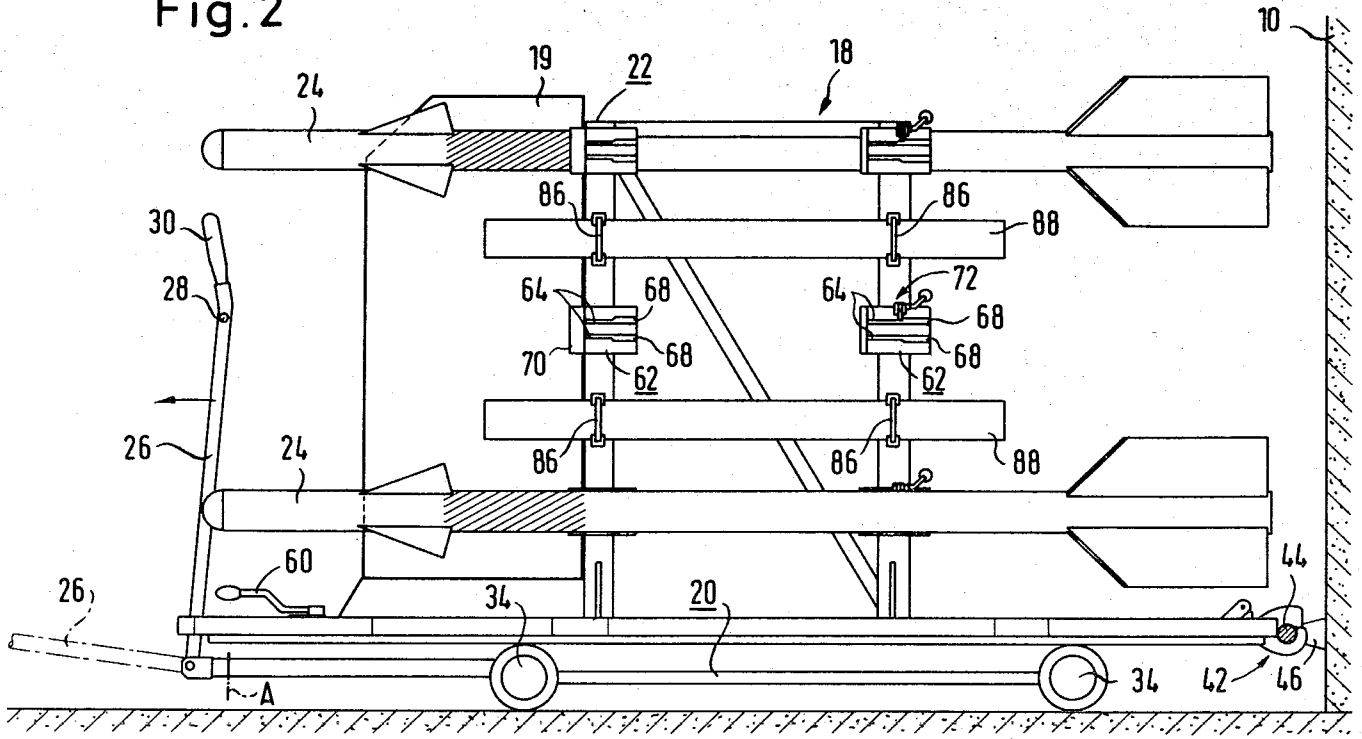
FIG. 2 is a side view of a storage structure for guided missiles embodying the present invention.

As shown in FIG. 2, storage structure 18 includes a four-wheel undercarriage 20 with a support structure 22 extending upwardly from the undercarriage. The support structure 22 is arranged to carry six guided missiles, three on each side of the support structure with the missiles arranged one above the other, note FIG. 3.

For the purpose of description, as viewed in FIG. 2, the left-hand end of the support structure 18 is its front end and the right-hand end is its rear end. Positioned at the front end of each support structure is a rod-like member 26 which can be pivoted between a towing position, shown in dot-dash lines in FIG. 2 and a parked position, shown in full lines in FIG. 2, that is, with the rod-like member extending approximately vertically and projecting upwardly from the undercarriage 20. Rod-like member 26, as can be seen more clearly in FIG. 2, has a handle 28 adjacent its upper end and a loop-shaped towing eye 30 at its upper end in the position shown in FIG. 3.

Figure 4:
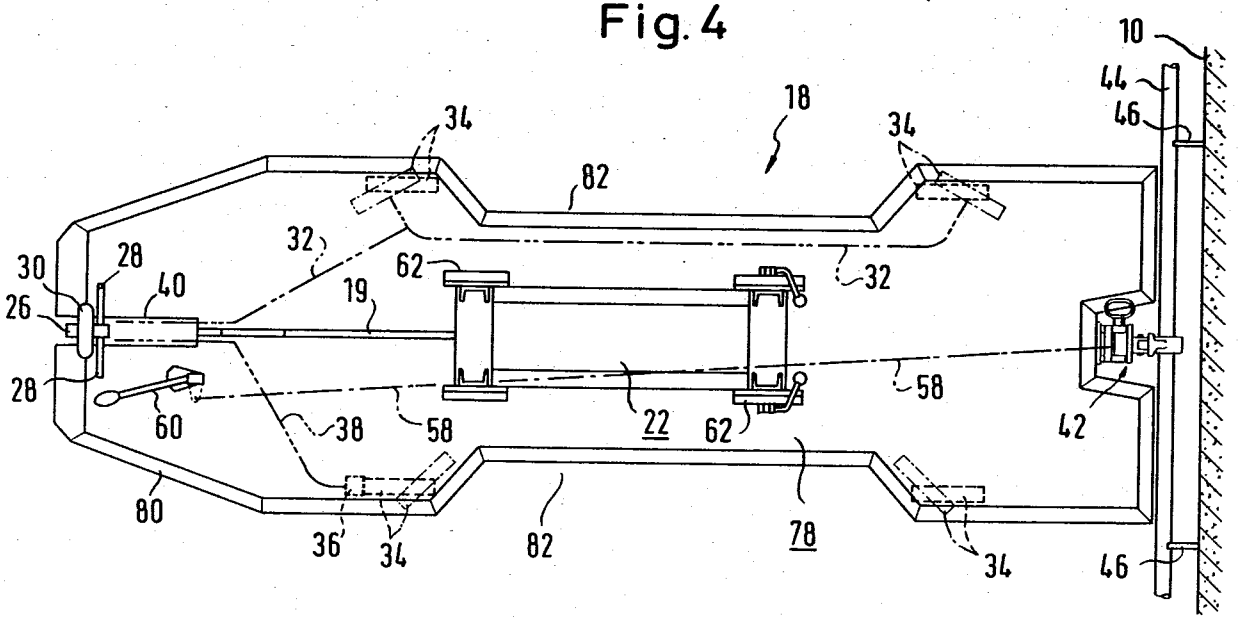
FIG. 4 is a top view of the storage structure illustrated in FIG. 2 without the guided missiles mounted on the structure.

A pair of front wheels 34 and a pair of rear wheels 34 are located in spaced relation on the undercarriage 20. All of the wheels 34 can be steered from the rod-like member 26, note the dash-double dot line 32 in FIG. 4. The wheels are steered by the rod-like member 26 as it is pivoted about a vertical axis A, note FIG. 2. Accordingly, one pair of wheels 34 located opposite each other on opposite sides of the undercarriage, are pivoted in the same direction while the other pair of wheels, that is the rear wheels, are pivoted in the opposite direction thereby permitting the storage structure 18 to turn on a minimum turning circle. As shown in FIG. 4 the wheels 34 are shown in dash lines in the normal travel position, that is oriented in the front end-rear end direction of the storage structure, while the wheels shown in dot-dash lines are pivoted from the normal travel position so that the support structure can move along a turning circle. The rod-like member 26 also actuates a brake shown in FIG. 4 as a brake shoe 36. The brake shoe 36 is actuated from the rod-like member by connecting members shown schematically by a dash-triple dot line 38 in FIG. 4. The brake shoe is positioned on the support structure so that it only interacts with the wheel 34 when the wheel is in the normal travel position, as shown in dash lines. In this position, the brake shoe can be placed in engagement with the revolving surface of the wheel 34 when the rod-like member is pivoted upwardly from the towing position shown in dash-dot line into the parked position shown by the solid line note FIG. 2, when the wheels are oriented in the normal travel position. This safety arrangement is indicated in FIG. 4 by a slot 40 into which the rod-like member 26 can engage only when it is in the normal travel position and when the wheels 34 are also oriented in the normal travel position.

As can be seen in FIGS. 2 and 4, the rear end of the storage structure 18 has a hook coupling 42 which can be used to connect the support structure to the loop-shaped towing eye 30 of the rod-like member 26 of a following storage structure. In FIGS. 2 and 4, however, another use of the hook coupling 42 is shown, that is, it serves as a safety catch in coupled engagement with a bar 44 extending along the bottom of side wall 10 of the storage building. The bar 44 is connected to the side wall 10 by a plurality of brackets 46 spaced apart from one another along the length of the wall.

FIG. 7 shows details of the hook coupling 42. The hook coupling includes a coupling hook 48 with an upwardly directed opening which can be closed by a pivotally movable closure 50 in a known manner for driving operation. Hook coupling 42 is attached to a carrier plate 52. The carrier plate 52 can be pivoted at the rear end of the undercarriage 20 about the horizontally extending pivot axis 54. In FIG. 7 the coupling hook is shown in a downwardly pivoted position so that it can move under the bar 44. After being positioned under the bar 44, the coupling hook is pivoted upwardly into engagement with the bar 44 so that it prevents the storage structure 18 from being moved in the normal travel direction away from the side wall 10. In its upwardly tilted position, the hook coupling 42 can be locked to the undercarriage 20 by means of a bolt, not shown, placed through the bolt eyes 55, 56. When the carrier plate 52 is pivoted upwardly the bolt eyes 55, 56 align with one another so that a bolt can be passed through them. One of the bolt eyes 55 is connected to the rear end of the undercarriage 20 while the other bolt eye 56 is secured to the carrier plate 52. Coupling hook 48 can be pivoted upwardly by means of a remote control device 58 operated by a manual lever 60 located adjacent the front end of the support structure, note FIG. 4 where the manual lever 60 is located closely behind the rod-like member 26.

Figure 5:
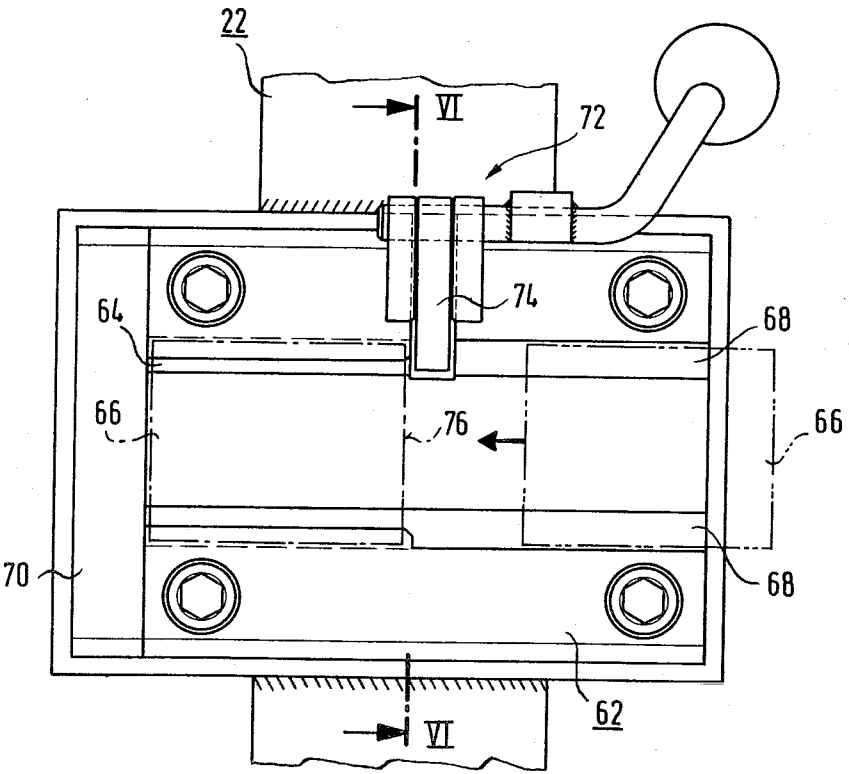
FIG. 5 is a side view of an attachment member for securing the guided missiles on the storage structure.
Figure 6:
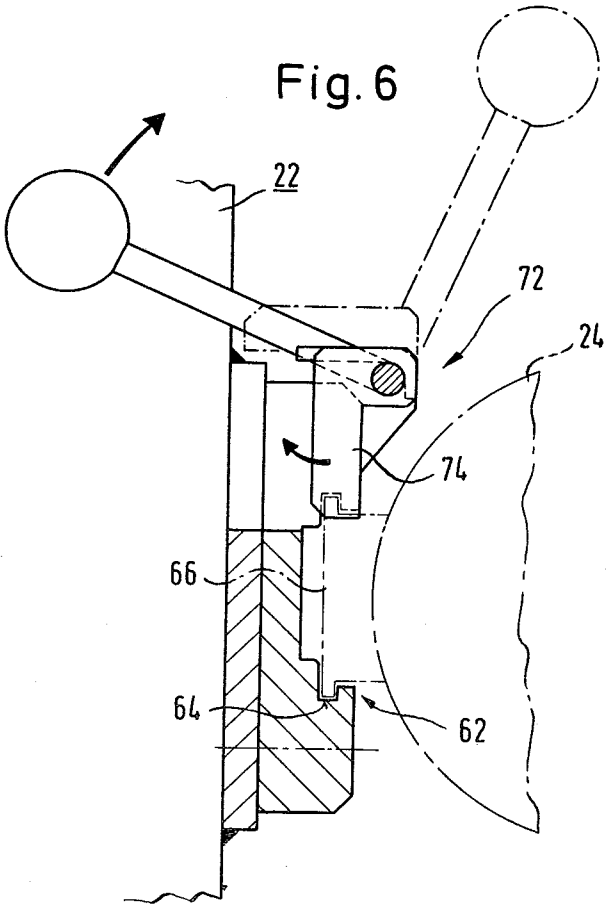
FIG. 6 is a sectional view taken along the line VI—VI in FIG. 5.

For mounting the guided missiles 24 on the vertical support structure 22 of the storage structure 18, profile guides 62 are located on both sides of the vertical structure with the guides extending in the normal travel direction, that is, the front end-rear end direction. As shown in FIG. 6, profile guides 62 are shaped for a portion of their lengths as dovetail profile guides 64. Further in FIG. 6, the guided missile 24 has appropriate dovetail shaped ledges 66 attached to it and these ledges can be slid into the guides 64. To facilitate the insertion of the shaped ledges 66 into the dovetail shaped guides 64 on the profile guides 62, as shown in FIG. 2, lead-in surfaces 68 are formed which direct the insertion of the shaped ledges 66 extending vertically in the drawing plane of FIG. 2, until the ledges 66 are aligned with the dovetail shaped guides 64, so that the ledges 66, as shown in FIG. 2, can be moved forwardly into engagement with the dovetail-shape guides 64 by movement in the leftward direction, as viewed in FIG. 2, until the guide ledges contact the stop plates 70. When this position has been reached, the safety mechanism, as shown in FIGS. 5 and 6, can be activated. This safety mechanism 72 includes a safety pawl 74 which, during insertion of the ledges 66 into the guides 62, is located in the position shown by dash-dot lines in FIG. 6. Subsequently, the safety mechanism 72 is pivoted into position shown in solid lines in FIG. 6 with the safety pawl 74 resting against the end 76 of the ledge 66 and preventing displacement of the guide ledge out of the dovetail guide, note also the right guide of FIG. 2.

Due to the impact of the guide ledges with the stop plate 70, in the position shown in FIG. 2, the guided missile 24 is prevented from shifting to the left in the event it should be accidentally ignited. Any thrust generated is then transferred to the storage structure 18 and via the tow coupling 42 to the bar 44 secured to the side wall 10 of the storage building.

As can be seen in FIGS. 3 and 4, storage structure 18 includes a platform 78 having a specially shaped outline as shown best in FIG. 4. This outline is selected so that the fins of the guided missiles 24, note FIG. 3, do not collide and become damaged when adjacent storage structures are moved relative to one another. In the region extending for the length of the support structure 22, recesses 82 are formed in the platform 78 which permit access to the guided missiles during loading and unloading by operating personnel. As can be appreciated in FIG. 1, with the storage structures 18 arranged in a row, the adjacent storage structures are spaced closely apart so that a walkway is not present between them.

In FIGS. 2 and 3, tubes 88 are shown attached to the vertical structure 22 by brackets 86. These tubes 88 can be used to store accessory parts for the guided missiles 24, that is, parts which are connected to the guided missiles only when they are mounted on a mission carrier ready for use. Therefore, these accessory parts are available during the loading of the guided missiles 24 on the mission carrier such as an aircraft, since they are located on the same movable storage structure which mounts the guided missiles for transportation from the storage building to the mission carrier.

In FIGS. 2, 3 and 4 a dividing wall 19 is provided along the longitudinal center plane of the storage structure 18. The dividing wall 19 extends from the platform 78 upwardly for the full height of the two rows of guided missiles 24 located on opposite sides of the support structure 22. In FIG. 2, the warheads in the guided missiles 24 are shown by hatching just forward of the support structure 22. The dividing wall 19 has a length in the long direction of the storage structure 18 at least of the same length as the warheads. The dividing wall 19 separates the warheads in the opposite vertically extending rows of guided missiles mounted on the support structure 22. With this arrangement, if one of the warheads should be exploded on one side of the storage structure, the warheads on the opposite side of the storage structure cannot be struck by flying fragments and, therefore, will not be exploded. In this manner it is made certain that, at worst, the warheads on one side of the storage structure and the warheads on the adjacent side of the adjoining storage structure can be struck by fragments and caused to explode. The storage building enclosing the storage structures 18 can be constructed so that it can withstand the explosion of such a group of warheads.

While specific embodiments of the invention have been shown and described in detail to illustrate the application of the inventive principles, it will be understood that the invention may be embodied otherwise without departing from such principles.

What is claimed is:

1. System for storing and transporting guided missiles and similar flying bodies including storage structures positionable in a storage location, wherein the improvement comprises that each of said storage structures has a front end and a read end with the front end-rear end direction of said storage structures representing the normal travel direction of said storage structures and a pair of sides extending in the front end-rear end direction, each of said storage structures including means for moving and steering said storage structures so that at least one row of said storage structures can be arranged in a storage location with said storage structures disposed in side-by-side relation, each of said storage structures being positioned alongside one another in said row in closely spaced relation so that the space therebetween is of a width insufficient to form a walkway to allow loading and unloading of said storage structures and individual said storage structures in said row can be moved in the normal travel direction of said storage structures out of said row and turned in the direction of said row of said storage structures without moving adjacent said storage structures in said row, said storage structure includes a safety catch for securing said storage structure in the storage location for preventing said storage structure from experiencing movement caused by an accidental thrust of a guided missile, means on said storage structure for mounting the guided missiles, and means arranged to be mounted on the guided missiles for interengaging said means for mounting the guided missiles on said storage structure, and said means for mounting said guided missiles on said storage structure and said means arranged on the guided missiles for interengagement with said means for mounting said guided missiles on said storage structure each including stops interacting with one another for preventing the guided missiles from moving relative to said support structure, said safety catch is mounted on the rear end of said storage structure, and remote control means are connected to said safety catch, said remote control means comprises an operating member located adjacent the front end of said storage structure for operating said safety catch.

2. System, as set forth in claim 1, wherein said moving and steering means being arranged to turn said storage structure on a minimum turning circle from the direction of said storage structures within said row to the direction of said row without moving adjacent said storage structures.

3. System, as set forth in claim 1, wherein said moving and steering means includes two pair of wheels mounted on said storage structure with each of said wheels in said pairs being steerable.

4. System, as set forth in claims 1, 2 or 3 wherein said moving and steering means includes a rod-like member secured to one end of said storage structure.

5. System, as set forth in claim 4, wherein said rod-like member comprises one end connected to said storage structure and the other end having a coupling member for attaching said storage structure to another storage structure or a tractor, and a handle located on said rod-like member adjacent said coupling member.

6. System, as set forth in claim 3, wherein one pair of said wheels is located closer to the front end of said storage structure than the other pair of said wheels, said moving and steering means comprises a rod-like member secured to one end of said storage structure, and each pair of said wheels being steerable in an opposite direction by said rod-like member.

7. System, as set forth in claim 1, wherein a support member is arranged to be secured in the storage location along which said row of storage structures extend, said safety catch being engageable with said support member so that said storage structures can be held in the storage location.

8. System, as set forth in claim 4, wherein said safety catch comprises a coupling member secured to the rear end of said storage structure at the opposite end from said rod-like member, an engagement member on the outer end of said rod-like member and said coupling member adapted to be engaged with said engagement member on another said storage structure.

9. System, as set forth in claim 8, wherein said coupling member comprises a hook coupling, a support bar secured in position in the storage location and said hook coupling being engageable with said support bar so that each of said storage structures in said row can be secured to said support bar by said hook coupling thereon.

10. System, as set forth in claim 9, wherein said safety catch includes a carrier plate secured to said hook coupling, said carrier plate being pivotably connected to the rear end of said storage structure about a horizontal axis extending transversely of the normal travel direction of said storage structure, and said hook coupling being movable into and out of engagement with said support bar by pivoting said carrier plate about said horizontal axis.

11. System, as set forth in claim 10, wherein said safety catch includes means for locking said hook coupling in hooked engagement with said support bar.

12. System, as set forth in claim 9, wherein said hook coupling comprises a hook-shaped member open at the top, said hook coupling being pivotally movable about a horizontal axis, and said hook coupling being movable under said support bar so that it can be pivoted upwardly into engagement with said support bar.

13. System, as set forth in claim 12, wherein said hook coupling includes a closure part pivotally mounted thereon between a first position for closing the opening in said hook and a second position displaced from said opening.

14. System, as set forth in claim 1, including first means on said storage structure for mounting the guided missiles and second means arranged to be attached to the guided missiles and interengageable with said first means for removably mounting the guided missiles on said storage structure.

15. System, as set forth in claim 14, wherein said first means comprising shaped guides attached to said storage structure, and said second means comprising ledges shaped to interengage with said shaped guides.

16. System, as set forth in claim 15, wherein said shaped guides extend in the normal travel direction of said storage structure and said shaped ledges being arranged to extend in the long direction of the guided missiles so that when mounted on said support structure the long direction of the guided missiles extends in the normal travel direction of said storage structure.

17. System, as set forth in claim 16, wherein each of said shaped guides and shaped ledges includes an end stop in contact engagement with one another when said shaped ledges are inserted into said shaped guides with said stops on said shaped guides effecting a stop of further movement of said shaped guides in the normal travel direction of said storage structure toward the front end thereof.

18. System, as set forth in claim 15, wherein said shaped guides having lead-in surfaces thereon for directing said shaped ledges into alignment with said shaped guides.

19. System, as set forth in claim 15, including means for blocking said shaped ledges in engagement with said shaped guides so that said shaped ledges are held in place in said shaped guides.

20. System, as set forth in claim 1, wherein said storage structure comprises a horizontally arranged undercarriage, a support structure for mounting the guided missiles extending upwardly from said undercarriage, spacer means located on each said storage structure for preventing the guided missiles mounted thereon from contacting the guided missiles on an adjacent said storage structure when said spacer means contact one another.

21. System, as set forth in claim 20, wherein said spacer means comprises a horizontally arranged platform extending transversely of and located at the lower end of said support structure, and said spacer means comprises a portion of the peripheral edge of said platform.

22. System, as set forth in claim 21, wherein said platform being recessed on both sides thereof extending in the front end-rear end direction of said storage structure so that operating personnel can gain access to the guided missiles mounted on said storage structure.

23. System, as set forth in claim 1, wherein said storage structure includes an upwardly extending support structure spaced approximately equidistantly from the front end and rear end of said storage structure, said support structure having a pair of opposite sides extending in the front end-rear end direction of said storage structure, and fastening means mounted on the sides of said support structure extending in the front end-rear end direction of said storage structure for mounting guided missiles thereon with each guided missile having a long axis.

24. System, as set forth in claim 23, including attachment means mounted on said sides of said support structure extending in the front end-rear end direction of said storage structure for holding accessory parts for the guided missiles, said attachment means being in spaced relation to said fastening means.

25. System, as set forth in claim 23, wherein said fastening means are arranged to secure the guided missiles on said support structure for holding the guided missiles against rotation about the long axes thereof and for spacing the fins of the guided missiles from the fins of adjacent guided missiles in the event of accidental turning of the missiles.

26. System, as set forth in claim 24, wherein said attachment means comprises tubular containers secured to said support structure for holding accessory parts for the guided missiles, said tubular containers extending in the front end-rear end direction of said storage structures.

27. System, as set forth in claim 23, wherein a dividing wall is positioned on said storage structure extending from said support structure toward the front end of said storage structure, said dividing wall arranged to separate the guided missiles mounted on each side of said support structure and said dividing wall having a length extending in the front end-rear end direction of said storage structure for preventing the explosion of a warhead on one side of said dividing wall when a warhead on the opposite side thereof accidentally explodes.

28. System, as set forth on claim 27, wherein said support structure arranged to support a vertically extending row of guided missiles on each side thereof extending in the front end-rear end direction of said storage structure, and said dividing wall extending upwardly on said support structure for approximately the full height of the rows on the opposite sides of said support structure.

29. System for storing and transporting guided missiles and similar flying bodies including storage structures positionable in a storage location, wherein the improvement comprises that each of said storage structures has a front end and a rear end with the front end-rear end direction of said storage structures representing the normal travel direction of said storage structures and a pair of sides extending in the front end-rear end direction, each of said storage structures including means for moving and steering said storage structures so that at least one row of said storage structures can be arranged in a storage location with said storage structures disposed in side-by-side relation, each of said storage structures being positioned alongside one another in said row in closely spaced relation so that the space therebetween is of a width insufficient to form a walkway to allow loading and unloading of said storage structures and individual said storage structures in said row can be moved in the normal travel direction of said storage structures out of said row and turned in the direction of said row of said storage structures without moving adjacent said storage structures in said row, said moving and steering means includes a rod-like member secured to the front end of each said storage structure, said safety catch comprises a coupling member secured to the rear end of each said storage structure, said rod-like member extends outwardly from each said storage structure and includes an engagement member on the end of said rod-like member spaced outwardly from each said storage structure, and said coupling member being engageable with said engagement member of another said storage structure.

* * * * *